US011478061B2

(12) United States Patent
De Bardonneche

(10) Patent No.: US 11,478,061 B2
(45) Date of Patent: Oct. 25, 2022

(54) APPLICATOR DEVICE FOR APPLYING A PRODUCT OF THE FLUID OR PASTY TYPE TO KERATIN FIBRES

(71) Applicant: MONTAIGU DEVELOPPEMENT, Chambourcy (FR)

(72) Inventor: Eric De Bardonneche, Courpalay (FR)

(73) Assignee: SOCIÉTÉ INDUSTRIELLE DE MATIERES PLASTIQUES (SIMP), Draveil (FR)

( * ) Notice: Subject to any disclaimer, the term of this patent is extended or adjusted under 35 U.S.C. 154(b) by 0 days.

(21) Appl. No.: 15/553,881

(22) PCT Filed: Feb. 24, 2016

(86) PCT No.: PCT/FR2016/050432
§ 371 (c)(1),
(2) Date: Aug. 25, 2017

(87) PCT Pub. No.: WO2016/135423
PCT Pub. Date: Sep. 1, 2016

(65) Prior Publication Data

US 2018/0242714 A1 Aug. 30, 2018

(30) Foreign Application Priority Data

Feb. 25, 2015 (FR) ..... 1551605

(51) Int. Cl.
*A45D 40/26* (2006.01)
*A46B 9/02* (2006.01)
(Continued)

(52) U.S. Cl.
CPC ..... *A45D 40/264* (2013.01); *A45D 40/262* (2013.01); *A46B 1/00* (2013.01);
(Continued)

(58) Field of Classification Search
CPC .. A45D 40/262; A45D 40/265; A45D 40/267; A46B 9/021; A46B 9/9028;
(Continued)

(56) References Cited

U.S. PATENT DOCUMENTS 6,581,610 B1 * 6/2003 Gueret ..... A45D 40/267 132/218
2001/0037815 A1 * 11/2001 Gueret ..... A46D 1/0253 132/218
(Continued)

FOREIGN PATENT DOCUMENTS

EP 1767119 A1 3/2007
EP 2196106 A1 6/2010
(Continued)

OTHER PUBLICATIONS

Translation of FR 2930875 retrieved from Espacenet (Year: 2019).*
(Continued)

*Primary Examiner* — Heidi M Eide
(74) *Attorney, Agent, or Firm* — Amster, Rothstein & Ebenstein LLP

(57) ABSTRACT

The present invention relates to an applicator device for applying a product of the fluid or pasty type to keratin fibres, comprising a central core (1) having an elongate shape which extends along a longitudinal axis XX, at least one row of elongate spikes (2) comprising a first end (20) embedded in the core and a second, free end (21). According to the invention, at least one of the spikes (2) is delimited by a first flat face (200) that is coincident with a longitudinal plane, known as the reference plane P, and by a second flat face (210) that forms an angle of between 10 and 180° with said first flat face, said at least one spike comprising a first region (22) that is embedded in the core (1) and has a substantially constant cross section in the form of a portion of a circle, and a second region (23) having a variable cross section that is
(Continued)

situated substantially in the longitudinal continuation of said first region (22).

8 Claims, 6 Drawing Sheets

(51) Int. Cl.
*A46D 1/00* (2006.01)
*A46B 1/00* (2006.01)

(52) U.S. Cl.
CPC ..... *A46B 9/021* (2013.01); *A46B 9/028* (2013.01); *A46D 1/00* (2013.01); *A46D 1/0238* (2013.01); *A46D 1/0253* (2013.01); *A46D 1/0292* (2013.01)

(58) Field of Classification Search
CPC ..... A46B 1/00; A46B 1/0238; A46B 1/0253; A46B 1/0292; A46B 9/028; A46D 1/00; A46D 1/0238; A46D 1/0253; A46D 1/0292
See application file for complete search history.

(56) References Cited

U.S. PATENT DOCUMENTS

2007/0062551 A1* 3/2007 De Brouwer ..... A45D 34/045 132/218
2010/0300475 A1* 12/2010 Gueret ..... A46B 9/021 132/218
2012/0170965 A1 7/2012 Kulik
2015/0020332 A1* 1/2015 Jacob ..... A46B 9/021 15/160
2016/0022012 A1* 1/2016 Jacob ..... A45D 40/265 401/129
2016/0135568 A1* 5/2016 Sanchez ..... A46B 9/021 401/129

FOREIGN PATENT DOCUMENTS

EP 2281478 B1 9/2015
FR 2505633 A1 11/1982
FR 2930875 A1 11/2009
FR 2993441 A1 1/2014
JP 2001-204543 A 7/2001

OTHER PUBLICATIONS

International Search Report of PCT/FR2016/050432 dated May 17, 2016.
Notice of Reasons for Refusal dated Apr. 7, 2020 in connection with Japanese Application No. 2017-563389.
EP Notification under Article 94(3) issued in Application No. 16 714 981.4 dated Jun. 15, 2021.

* cited by examiner

X
X
2
1

1
2

21
20
P 2
20
21

2
1
P

FIG. 4C
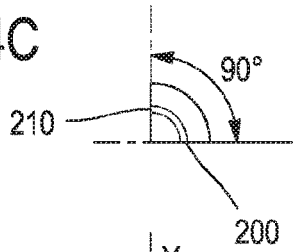
FIG. 5C
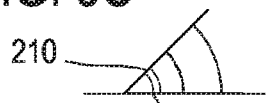
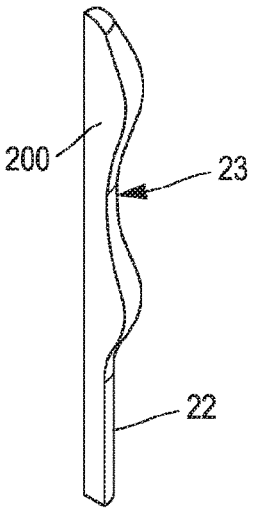
FIG. 4A
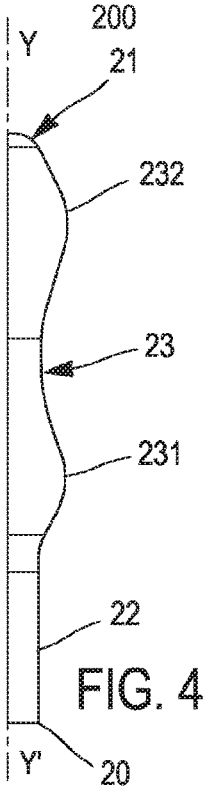
FIG. 4B
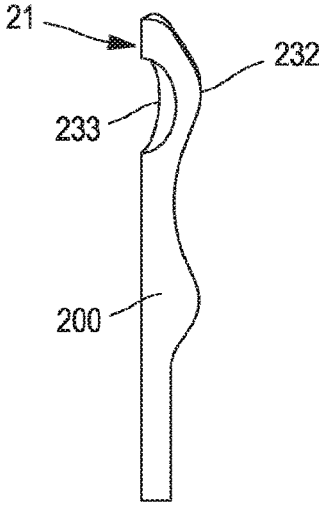
FIG. 5A
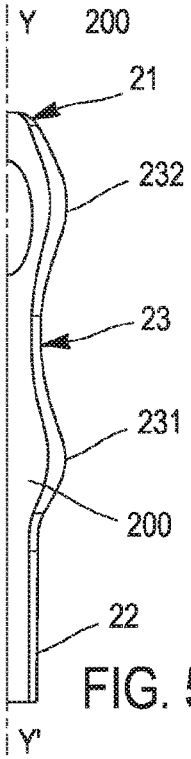
FIG. 5B
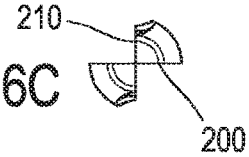
FIG. 6C
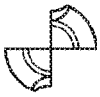
FIG. 7C
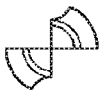
FIG. 8C
FIG. 6A
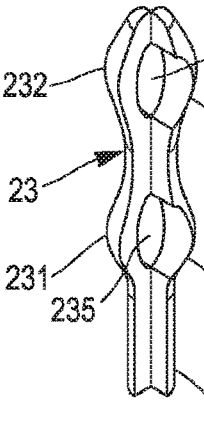
FIG. 6B
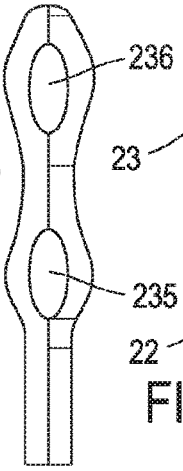
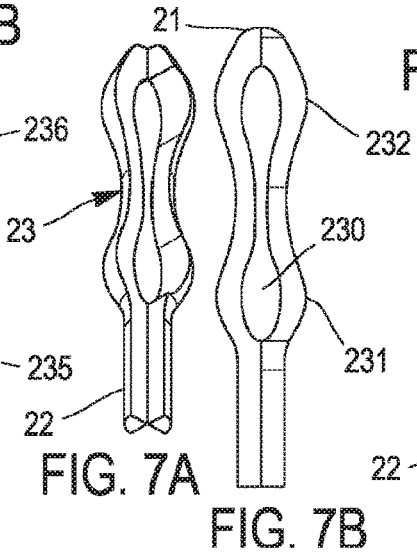
FIG. 7A
FIG. 7B
FIG. 8A
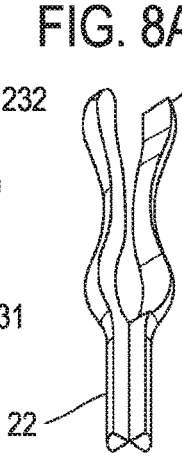
FIG. 8B
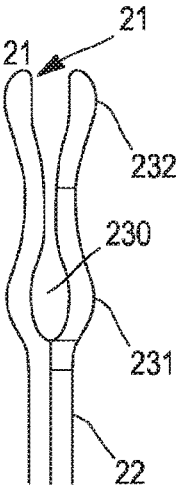

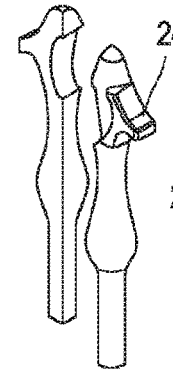
FIG. 9A
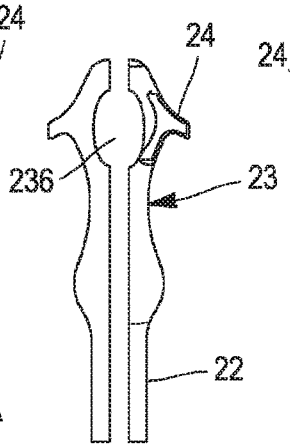
FIG. 9B
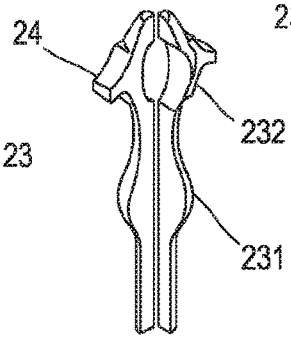
FIG. 9C
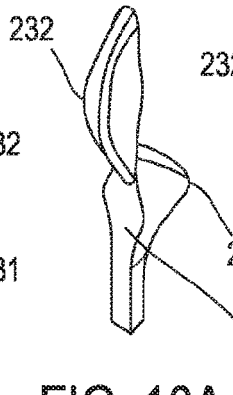
FIG. 10A
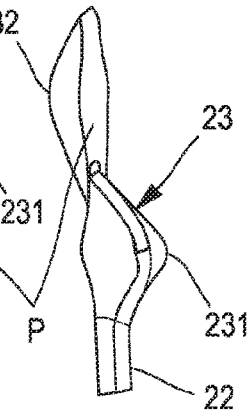
FIG. 10B
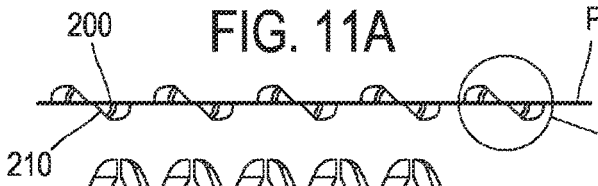
FIG. 11A
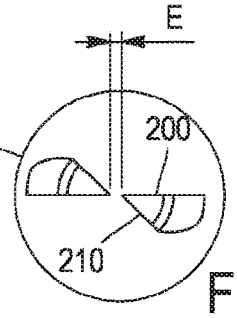
FIG. 11B
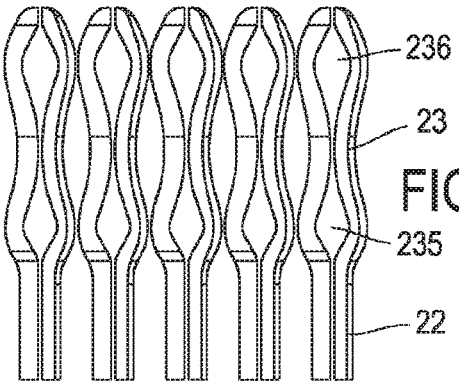
FIG. 11
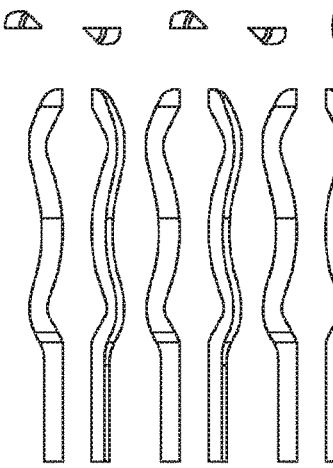
FIG. 12A
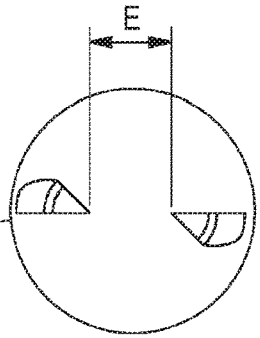
FIG. 12B
FIG. 12
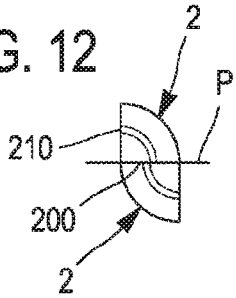
FIG. 13A
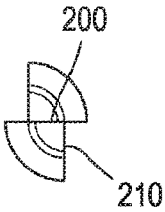
FIG. 13B
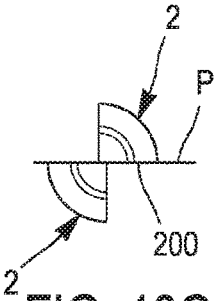
FIG. 13C

APPLICATOR DEVICE FOR APPLYING A PRODUCT OF THE FLUID OR PASTY TYPE TO KERATIN FIBRES

TECHNICAL FIELD OF THE INVENTION

The invention relates to the field of applicators for a fluid or viscous cosmetic product, of the mascara type. The invention relates more specifically to the device or means for applying the cosmetic product.

PRIOR ART

In the prior art very many mascara applicators are known. The application device in itself may for example be an elongate-shaped brush, provided with a central core from which a set of bristles or spikes extends. The bristles are old technology: a twisted metal wire holds bristles that extend transversely. An example of application is illustrated in the American U.S. Pat. No. 5,611,361.

More recently, the application device is in the form of a brush comprising a series of spikes embedded on the longitudinal core of the brush. The whole is moulded from plastic material. An application device thus forms, with a suitable reservoir in which it can be inserted, a dispenser for cosmetic product. The applications FR 2 810 860 and WO 2011/045770 show a few examples of applicators issuing from this concept.

The drawbacks of the application devices, or brushes, of the prior art are that the spikes do not make it possible to correctly effect the transfer of the cosmetic product from the reservoir onto the spikes and a suitable application of the product to the keratin fibres, in order to extend, thicken and/or separate them.

One solution envisaged by the prior art for improving the loading of the brushes with mascara consists of using spikes having a flat face for collecting the mascara while the non-flat face participates in the separation of the eyelashes. The document EP 1 872 682 describes such a brush. The spikes are disposed on rows parallel to the longitudinal axis of the brush and all the spikes on a row have their flat face on the same side: the flat faces are aligned while the non-flat faces are situated on the same side of the line. The user of the brush therefore imparts a movement of the brush in a direction perpendicular to the longitudinal axis of the brush, while turning the latter.

The brushes of this type do not have maximum efficacy since the flat faces do not participate in the separation of the eyelashes and the non-flat faces do not participate in the loading with mascara. With this type of brush, the user is therefore forced to make several passages over the eyelashes while reversing the movement of the brush in order to ensure that a sufficient load of mascara is recovered.

Somewhat differently, the patent application EP 1 611 817 discloses a mascara-application device comprising a longitudinal support, first and second rows of spikes produced in a single piece with the support, embedded on the same side of the support and extending over more than one quarter of the length of the support. The teeth (or spikes) extend on either side of a so-called separation geometric surface formed in two non-parallel directions and surfaces. The spikes are erected from a flat face of the support, and are formed staggered on either side of the separation surface. Thus, when mascara is applied, the to and fro movement imparted to the brush does not allow optimum distribution of the load or suitable separation of the eyelashes.

The patent application FR 2 930 875 is also known, which describes a device for applying a cosmetic product comprising a longitudinal core supporting a plurality of rows of spikes having a flat face and projected radially from the core. The spikes are distributed in at least one row parallel to the longitudinal axis of the core, so that, on any one row, the spikes are positioned alternately on either side of a centre line (or plane) of the row, with their flat face turned towards the inside of the row. According to one feature of the invention, the flat faces of the spikes in the same row extend perpendicular to the core and are aligned, and are oriented in the two gyratory directions around the core.

Even though this solution affords a certain improvement vis-à-vis the prior art, modularity of the load is not obtained favourably. Furthermore the separation of the eyelashes leaves room for improvement.

A development therefore is necessary, in particular with regard to the shape of each spike. Each spike must help to improve, alone or in combination with other spikes, both the loading with product and the separation of the eyelashes or keratin fibres.

DISCLOSURE OF THE INVENTION

The invention aims to remedy the drawbacks of the prior art, in particular with regard to the loading with cosmetic product and the separation of the eyelashes.

To do this, according to the invention, a device for applying a product of the fluid or viscous type to keratin fibres is proposed, comprising an elongate-shaped central core that extends along a longitudinal axis XX, at least one row of elongate spikes comprising a first end embedded on the core and a second free end, the spikes on the core being formed in a single piece. According to a first aspect of the invention, at least one of the spikes is delimited by a first flat face coincident with the longitudinal plane of the device, referred to as the reference plane P, and by a second flat face forming with said first flat face an angle of between 10° and 180°. Furthermore, said at least one spike comprises a first region embedded on the core and with a substantially constant cross-section in the form of a portion of a circle, and a second region with a variable cross-section situated substantially longitudinally in line with said first region.

These features, which constitute a precise technical definition of the form and individual and/or mutual arrangement of the spikes, improve the functions stated above.

Advantageously, the form and/or arrangement of two spikes successively implanted along the axis XX is able to create at least one distal opening between them. Said distal opening may be open towards the free end of the spike, in the general shape of a tuning fork.

Without departing from the scope of the invention, the form and/or arrangement of two spikes successively implanted along the axis XX is able to create a second opening between them. According to the option envisaged, the distal opening and the second opening may be distinct or communicating.

Furthermore, according to one embodiment of the invention, at least two of the spikes constituting a row have identical orientation.

According to another embodiment of the invention, at least two of the spikes constituting a row have different orientations.

Moreover, the distance measured along the axis XX between two successive spikes may be negative, zero or positive, less than approximately 2 mm. This distance can easily be adapted to the particular case envisaged.

According to a particular embodiment of the invention, the first and second faces form between them an angle of approximately 180°, and the second region comprises at least one first portion juxtaposed with and in line with the first region, and a second portion juxtaposed so as to overlap with the first portion along said reference plane P.

More precisely, said first portion comprises a first bulge; the second portion comprises a second bulge oriented differently from said first bulge.

According to another alternative of the invention, said second portion of the second region has a U shape that extends substantially parallel to said reference plane, on the other side of said reference plane P in relation to the first portion.

Furthermore, the second region of the spike or spikes may extend in a succession of concave and convex curvatures.

Departing from the scope of the invention, at least one of the spikes comprises at least one protrusion issuing from a bulge and/or from a convexity.

BRIEF DESCRIPTION OF THE FIGURES

Other features and advantages of the invention will emerge from a reading of the following description, with reference to the accompanying figures, which illustrate:

FIGS. 4A, 4B and 4C show a spike respectively in perspective, in side view and in plan view, according to a variant of the invention;

FIGS. 5A, 5B and 5C show a spike respectively in perspective, in side view and in plan view, according to another variant of the invention;

FIGS. 6A, 6B and 6C show an arrangement of two spikes respectively in perspective, in side view and in plan view, according to a variant of the invention;

FIGS. 7A, 7B and 7C show an arrangement of two spikes respectively in perspective, in side view and in plan view, according to a variant of the invention;

FIGS. 8A, 8B and 8C show an arrangement of two spikes respectively in perspective, in side view and in plan view, according to a variant of the invention;

FIGS. 9A, 9B and 9C relate to a variant of the spikes in FIG. 5;

FIGS. 10A and 10B show a variant of spikes according to the invention;

FIG. 11 shows an arrangement of spikes in rows, seen from the side;

FIG. 11A illustrates the same arrangement, seen from above;

FIG. 11B is a detail of FIG. 11A;

FIG. 12 shows an arrangement of another form of spikes, in rows, seen from the side;

FIG. 12A illustrates the same arrangement seen from above;

FIG. 12B is a detail of FIG. 11A;

FIGS. 13A, 13B, 13C illustrate various longitudinal separations between two successive spikes;

For more clarity, identical or similar elements are marked by identical reference signs in all the figures.

In the remainder of this text, "applicator" or "applicator device" or "application device" are used to define the same technical means.

DETAILED DESCRIPTION OF AN EMBODIMENT

Figures 1, 1A, 1B, 2A, 2B, 3A, 3B:
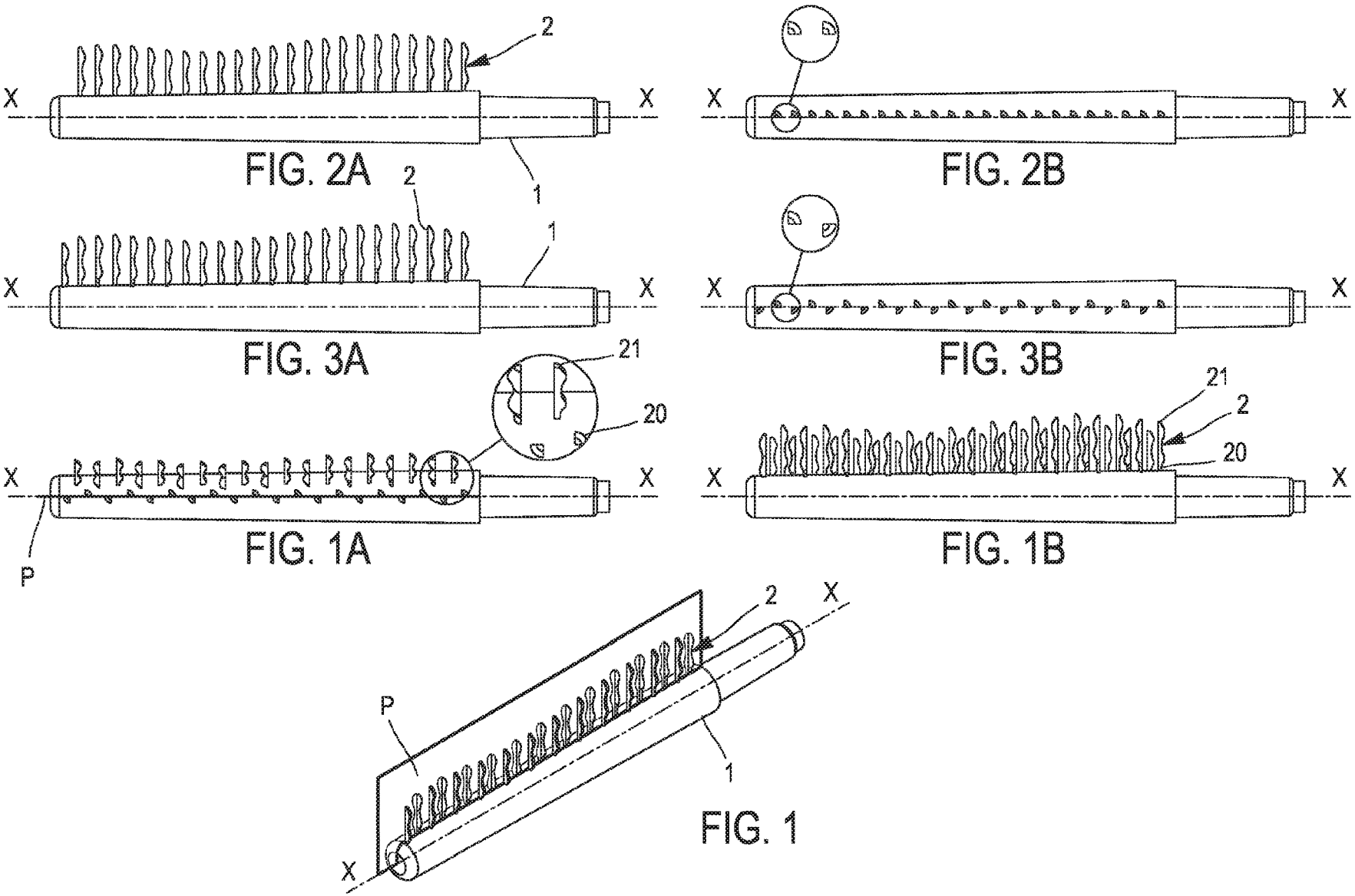
FIG. 1, a perspective view of an applicator device according to a first embodiment of the invention.
FIG. 1A, a side view of said applicator.
FIG. 1B, a plan view of said applicator.
FIG. 2A, a side view of an applicator according to a second embodiment of the invention.
FIG. 2B, a plan view of a second embodiment of the invention.
FIG. 3A, a side view of an applicator according to a third embodiment of the invention.
FIG. 3B, a plan view of a third embodiment of the invention.

FIG. 1 shows the principle of the invention, which therefore relates to a device for applying a product of the fluid or viscous type to keratin fibres such as eyelashes. In a known fashion, this device comprises an elongate core 1 that extends along a longitudinal axis XX; the cross-section of the core may be constant or not. At least one row of spikes or protuberances 2, roughly elongate in shape, comprise a first end 20 embedded on the core 1 and a second free end 21; the spikes 2 and the core are advantageously formed in a single piece, in particular from a moulded plastic material. The application device is roughly elongate in shape and its external volume may take various forms: cylindrical, truncated cone, peanut shape or other; a person skilled in the art chooses it according to the precise case. FIGS. 1A and 1B show a substantially cylindrical external volume; FIG. 2A, an external form in a peanut shape; FIG. 3A, an undulating shape.

According to the invention and as illustrated for example in FIGS. 4 to 13, at least one of the spikes is delimited by a first flat face 200 coincident or substantially coincident with a so-called longitudinal or reference plane P that extends radially vis-à-vis the core 1. FIG. 1 shows clearly the plane P; this figure also illustrates a row of spikes 2 that have a face coincident with the plane P.

The spikes 2 (or at least one of them) are also defined and delimited by a second flat face 210 forming with the first flat face 200 an angle of between approximately 10° and 180°. The various figures that follow show the angles that can be envisaged, which are chosen, determined and calculated by a person skilled in the art.

Furthermore, at least one spike 2 comprises a first region 22 embedded on the core 1; this region corresponds to the embedding 21 and has a substantially constant cross-section, preferably in the form of a portion of a circle; it is the "root" or anchoring of each spike on the core 1. Longitudinally in line with the first region 22, a second region 23 is considered, which may have various forms, as illustrated in particular but not exhaustively by the accompanying figures.

According to FIGS. 4A, 4B, 4C, the first 200 and second 210 faces of the spike in question form a right angle between them, as shown clearly by FIG. 4C. The first region 23 has here a first bulging portion—or first bulge—231 juxtaposed with and in line with the first region 22, and a second bulging portion—or second bulge—232 in line with the first bulge 231.

FIGS. 5A and 5B relate to an embodiment that differs from that in FIG. 4 in that the second bulging portion 232 has a recess 233 at the distal part of the spike. FIG. 5B also differs through the angle between the two faces 200, 210 of the spike: this angle is here approximately 45°. This spike is therefore finer and, all other things being equal, more flexible than the one illustrated by FIG. 4.

FIGS. 6A, 6B and 6C illustrate the mutual arrangement of two adjacent spikes, as well as their intrinsic form. Unlike the spike in FIGS. 5A, 5B and 5C, the form of each spike comprises two recesses 233 and 234, substantially in line with each other. These recesses are able to form two openings 235, 236 in line with each other, with an appropriate mutual arrangement of two successive spikes.

The faces 200 and 210 are here oriented at 90° from each other, although this orientation could be different without departing from the scope of the invention. The two spikes 2 have a different orientation, at 180°.

FIGS. 7A, 7B, 7C show a form of the second region 23 similar to that of FIG. 6, but with a substantially constant cross-section. This form makes it possible, through a suitable chosen arrangement, to form, between two longitudinally juxtaposed spikes, a large elongate opening 230 closed at the distal end 21.

A variant of the embodiment in FIGS. 7A, 7B, 7C is shown in FIGS. 8A, 8B and 8C. The difference lies in the opening 230, which is not closed at the distal end 21. A kind of tuning fork constitutes here the second region 23, which benefits from a flexibility that is advantageous both for serving as a product reservoir and for holding and guiding the keratin fibres.

FIGS. 9A, 9B and 9C relate to spikes 2 of the type presented above, to which a lug or protrusion 24 is added, issuing from a bulge and/or a convexity 232. There also, this geometry is advantageous for improving the guidance of the keratin fibres. Moreover, it is sought here advantageously to form an opening 236, at the distal end of two juxtaposed spikes.

FIGS. 10A and 10B illustrate a spike 2 that can be produced in two ways: either by a contact juxtaposition of two spikes, the first 200 and second 210 faces of which form between them an angle of 90°; or by a single spike the first and second faces of which form an angle of 180°. In both options, two bulges 231, 232 are provided at the second region 23, and these two bulges issue from the flat region or regions 200, 210. The bulges are oriented at 180° from each other; they have a contact surface coincident with a reference plane P.

FIGS. 11, 11A and 11B show an embodiment of the invention according to which the spikes 2 are delimited by a first flat face 200 and a second flat face 210 forming between them an angle of approximately 45°. The second regions 23 of the spikes are formed by a succession of concave and convex curvatures. The arrangement of two adjacent spikes is such that a distance E of approximately 0.01 mm can be measured along the longitudinal axis XX of the application device. The orientation of two adjacent spikes is not the same since the second flat faces 210 are situated in alternation on either side of the reference longitudinal plane P, while the first faces 200 belong to the reference plane P. This arrangement makes it possible to form in space two substantially distinct openings 235, 236.

FIGS. 12, 12A, 12B present an embodiment that differs from the one in FIGS. 11, 11A and 11B through the longitudinal distance E of implantation between two spikes. This distance is approximately ten times greater, so that the openings 235, 236 are not closed. A person skilled in the art chooses the most suitable version.

FIGS. 13A, 13B and 13C show three possible separations between two longitudinally adjacent spikes 2. According to FIG. 13A, two adjacent spikes have a maximum overlap surface at their first flat faces 200; according to FIG. 13B, the overlap surface is approximately half of the first flat surfaces 200; according to FIG. 13C, only a small portion of the contact surface is provided.

Figure 14:
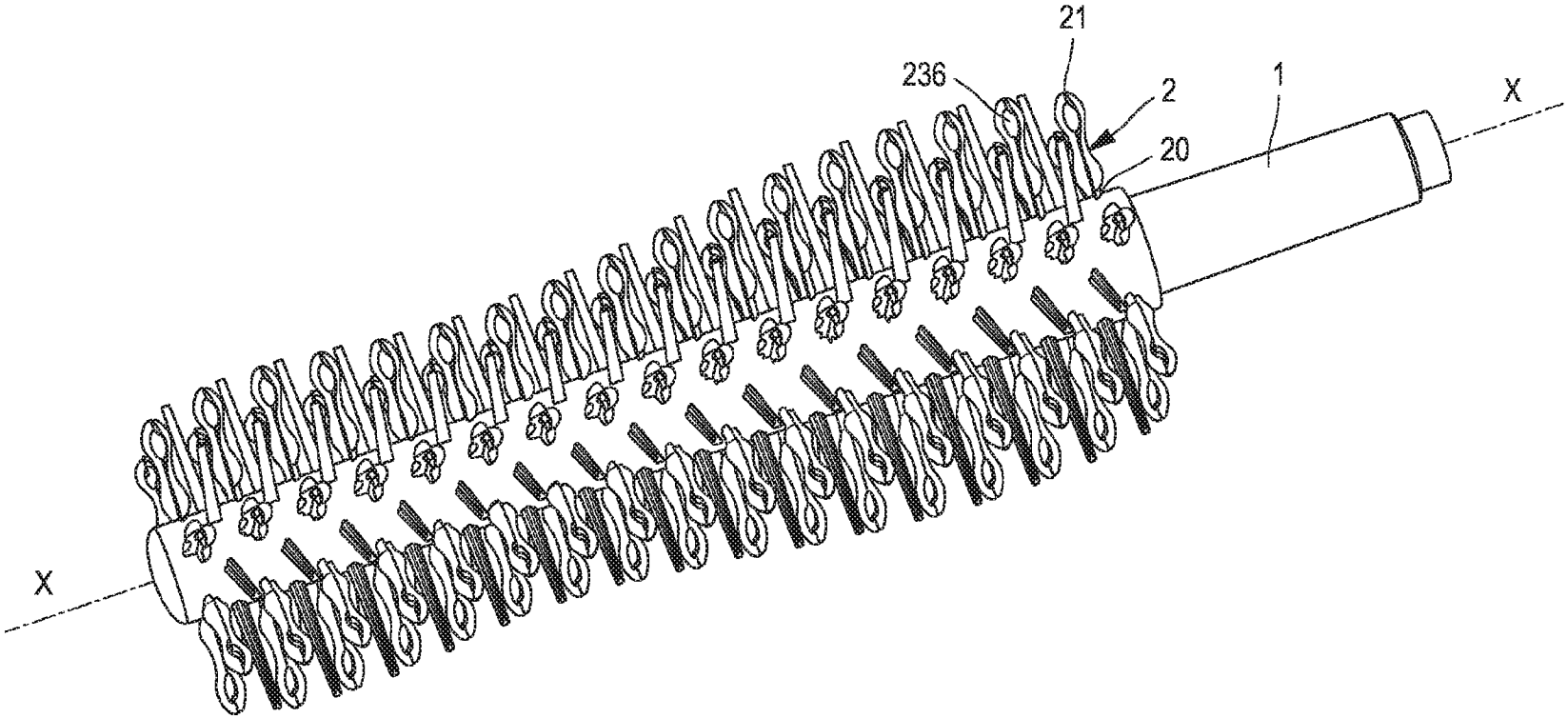
FIG. 14 is a perspective view of an applicator device according to one of the embodiments of the invention.

FIG. 14 illustrates, by a perspective view, a preferred embodiment of the invention. An advantageous aspect of this embodiment relates to the distal openings 236 formed by two successive spikes 2, on a plurality of rows of spikes. These openings 236 serve as a reservoir for the fluid or viscous product. Such reservoirs easily fill with product since they are disposed at the periphery of the volume occupied by the application device; the openings moreover being formed by two free ends of spikes, they are particularly flexible, which is advantageous for the repeated passages of the applicator devices through the wipers—small discs placed at the neck of the container.

Figure 15:
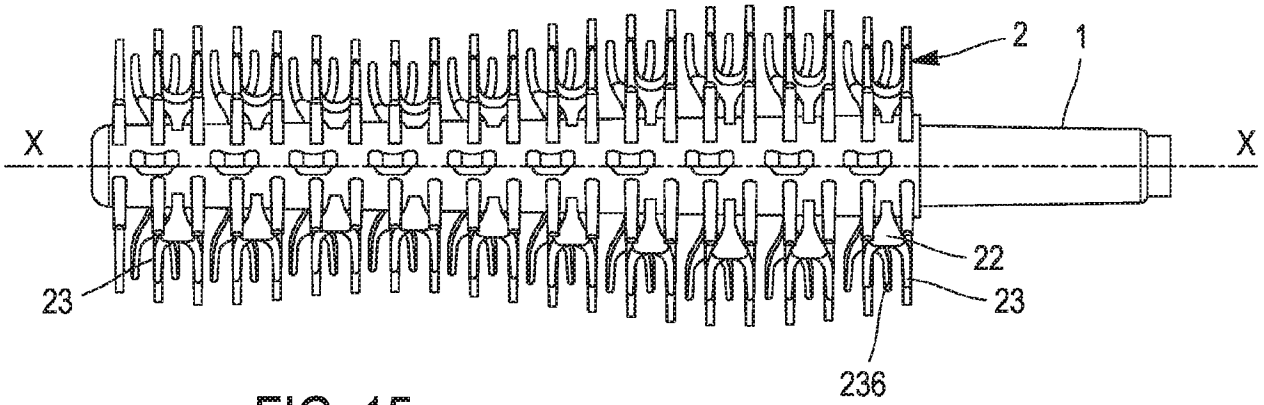
FIG. 15 is a side view of an applicator device according to another embodiment of the invention.
Figure 15B:
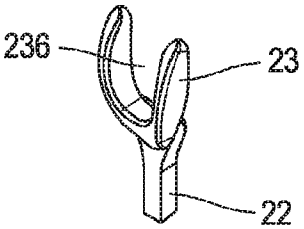
FIG. 15B is a detail view of the spikes constituting an applicator according to FIGS. 15 and 15A.
Figure 15A:
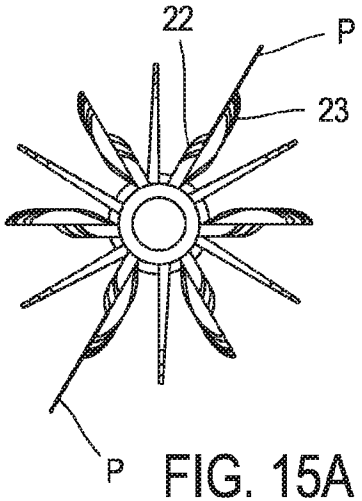
FIG. 15A is a front view of an applicator device according to FIG. 15.

FIGS. 15, 15A and 15B relate to a solution where the second portion of the second region 23 of the spike has a U shape, the top of which is juxtaposed with the first region 22 at a longitudinal plane P. FIG. 15A shows this arrangement clearly. According to FIGS. 15 and 15A, a plurality of rows of spikes (six) as described above are provided, radially spaced apart on the core. Other types of spike 2 may be provided on a core 1, for example radially interposed between the two U-shaped spikes. FIG. 15B shows in more detail a spike 2 as described above.

Figure 16A:
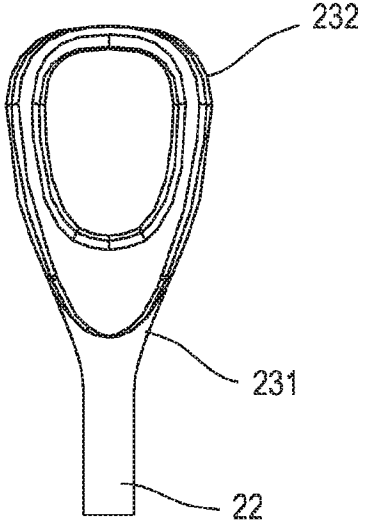
FIG. 16A is a side view of the spike of FIG. 16.
Figure 16B:
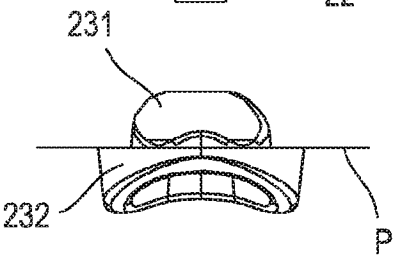
FIG. 16B is a plan view of the spike according to FIG. 16.
Figure 16:
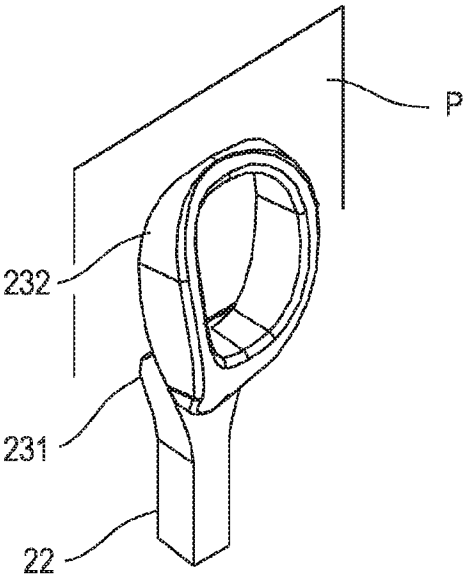
FIG. 16 is a perspective view of an another embodiment of a spike according to the invention.

A variant embodiment of the invention is illustrated in FIGS. 16, 16A and 16B. According to these figures, the spike comprises a first region 22 embedded on the core, as already defined; the spike further comprises a second region 23 here defined by a first part 231, the two faces of which form an angle of 180° and belong to the reference plane P. The part 231 is situated longitudinally in line with the first region 22 and is juxtaposed so as to overlap in the plane P with a second part 232, the distal part, which projects from the other side of the plane P, as shown in particular in FIG. 16B. The part 232 has an opening or closed loop at its distal end (not referenced but corresponding to the opening 236 of the other embodiments of the spikes). In other words, the spike is here "distributed" on either side of the plane P. It has all the features and advantages of the other embodiments of the invention.

Figure 17A:
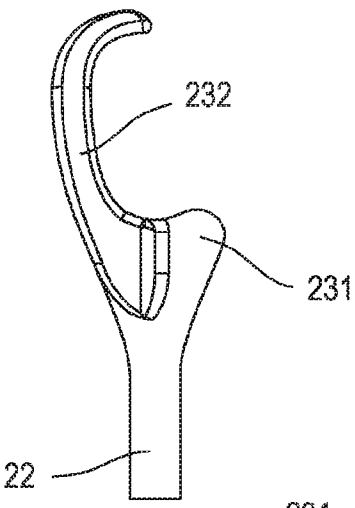
FIG. 17A is a side view of the spike of FIG. 17.
Figure 17B:
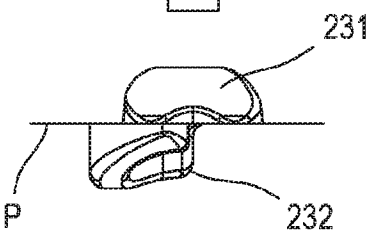
FIG. 17B is a plan view of the spike according to FIG. 17.
Figure 17:
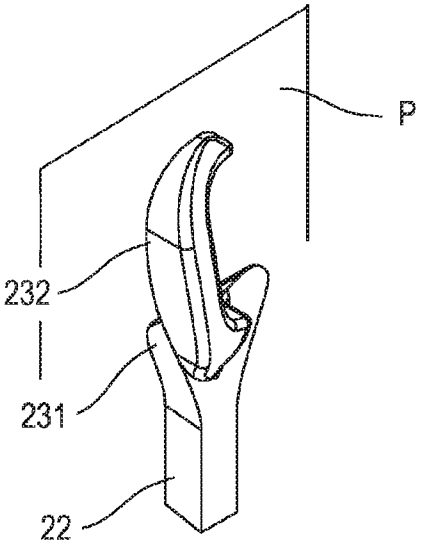
FIG. 17 is a perspective view of yet another embodiment of a spike.

FIGS. 17, 17A and 17B relate to an embodiment similar to the one illustrated by FIG. 16. The main difference lies in the form of the second part 232, which here corresponds to a distally open hook. This embodiment, more flexible than the one in FIGS. 16, 16A, 16B will therefore be chosen by a person skilled in the art when greater flexibility is required. The distal opening 236 is here open since it is defined by the hook 232.

Without departing from the scope of the invention, the variants in FIGS. 16 and 17 could be implemented by two spikes, the flat faces 200, 210 of which form between them an angle of 90°, and the faces 210 of which, not belonging to the reference plane P, are placed against each other.

Moreover, the number of rows of spikes preferentially varies from one to twenty-four, with spikes and arrangements of spikes that are identical or not. In particular, as shown in FIG. 2B, the spikes could all be oriented in the same way on the same row or over all the spikes constituting the application device; the spikes may also have different orientations, for example alternating on either side of the longitudinal plane P.

Other non-essential modifications may be made either to the intrinsic form of the spikes, or to their orientation and/or mutual arrangement, without departing from the scope of the invention. Naturally the applicator device according to the invention may have spikes issuing from various embodiments according to the invention and in particular illustrated and described above.

Naturally a person skilled in the art knows how to size in particular the spikes, the separations between the spikes and the core in order to meet the required technical needs.

The invention claimed is:

1. An applicator device for a product of the fluid or viscous type on keratin fibres, comprising an elongate-shaped central core (1) that extends along a longitudinal axis XX, at least one row of a plurality of elongate spikes (2) being integrally formed with the core (1), each elongate spike (2) comprising a first region (22) having a first end (20) located on the core and a second free end (21), a first flat face (200) coincident with a longitudinal plane of the device, called reference plane P and that extends radially relative to said central core (1) and through the longitudinal axis XX, and by a second flat face (210) forming with said first flat face (200) an angle of 45° or 90°, the first flat face intersecting with the second flat face along a line that extends through the reference plane P, the first region comprising a substantially constant cross-section in the form of a portion of a circle, each elongate spike further comprising a second region (23) with a variable cross-section extending from said first region (22) to the second free end (21), the first flat face and the second flat face being disposed within the second region (23), wherein the plurality of spikes comprises at least two spikes arranged adjacent to one another and oriented at 180° with respect to one another so as to be disposed at opposite sides from one another with respect to the reference plane P to create at least one distal first opening (230; 236) between them.

2. A device according to claim 1, wherein that the two spikes (2) of the at least one row of a plurality of elongate spikes create a second opening (235) between them adjacent to the at least one distal first opening.

3. A device according to claim 2, wherein the distal first opening and the second opening are distinct or communicating.

4. A device according to claim 1, wherein said distal first opening (236) is open towards the free end of each of the two spikes of the at least one row of a plurality of elongate spikes.

5. A device according to claim 1, wherein a distance measured along the longitudinal axis XX between the at least two spikes of the plurality of elongate spikes is less than approximately 2 mm.

6. A device according to claim 1, wherein a surface connecting the first flat face and the second flat face defines the second region, and the second region of each spike of the at least one row of a plurality of elongated spikes extends from the first region to the second free end in a succession of concave and convex curvatures.

7. A device according to claim 1, wherein a surface connecting the first flat face and the second flat face defines the second region, the second region of each spike of the at least one row of a plurality of elongate spikes extends from the first region to the second free end along a convex curvature, and at least one protrusion extends from the convex curvature.

8. A device according to claim 1, wherein a portion of the first flat face is wider than other portions of the first flat face so that a bulge is formed in the second region of each spike of the at least one row of a plurality of elongate spikes (2) and at least one protrusion (24) extends from the bulge.

* * * * *